US006089809A

United States Patent [19]

Dellinger

[11] Patent Number: 6,089,809

[45] Date of Patent: Jul. 18, 2000

[54] APPARATUS FOR LIFTING WALLS TO A VERTICAL POSITION

[76] Inventor: John W. Dellinger, Rte. 2 Box 380, Timberville, Va. 22853

[21] Appl. No.: 09/336,197

[22] Filed: Jun. 18, 1999

Related U.S. Application Data

[60] Provisional application No. 60/089,946, Jun. 19, 1998.

[51] Int. Cl.[7] ..... E04G 21/14

[52] U.S. Cl. ..... 414/11; 212/901; 254/338; 52/127.2

[58] Field of Search ..... 414/10, 11; 212/901; 52/127.2; 254/334, 338, 356

[56] References Cited

U.S. PATENT DOCUMENTS

| | | | |
|---|---|---|---|
| 81,317 | 8/1868 | Williams | 212/901 |
| 2,203,113 | 6/1940 | Uecker et al. | 254/338 |
| 2,615,584 | 10/1952 | Adams | 212/901 |
| 2,812,077 | 11/1957 | Proctor | 414/11 |
| 2,859,884 | 11/1958 | Pearce | 414/11 |
| 2,907,477 | 10/1959 | Coleman | 414/11 |
| 3,181,707 | 5/1965 | Janssen | 254/338 |
| 3,485,386 | 12/1969 | Miller | 414/11 |
| 5,322,404 | 6/1994 | Keller | 414/11 |
| 5,634,301 | 6/1997 | Koller | 52/127.2 |
| 5,833,430 | 11/1998 | Reynolds et al. | 414/11 |

*Primary Examiner*—Gregory A. Morse
*Attorney, Agent, or Firm*—Sheldon H. Parker

[57] ABSTRACT

A device for use in raising a wall, includes a footing member, an upright member, having a first end and a second end, a pulley, a flexible cable, the flexible cable having a first end and a second end, a cable guide member, a cable guide offset member, the cable guide offset member having a first end and a second end, and a wall engaging member. The upright member first end is fixed to the footing member and extends in a substantially vertical direction from said footing member. The footing sits on a floor or other generally horizontal surface. The cable guide member is secured to the cable guide offset member first end, and the cable guide offset member second end is fixed to said upright member second end. The flexible cable has its first end secured to the pulley, and its second end secured to the wall engaging member, and is supported between its two ends by the cable guide member.

20 Claims, 12 Drawing Sheets

APPARATUS FOR LIFTING WALLS TO A VERTICAL POSITION

CROSS-REFERENCE TO RELATED PATENT APPLICATION

The present application claims the benefits under 35 U.S.C. 119 (e) of provisional patent application Ser. No. 60/089,946, filed Jun. 19, 1998. This application incorporates by reference, as though recited in full, the disclosure of co-pending provisional patent application Ser. No. 60/089,946.

BACKGROUND OF THE INVENTION

1. Field of the Invention

The invention relates to a portable device to move large items, such as pre-built walls, into, or out of, the vertical position.

2. Brief Description of the Prior Art

The construction of buildings with prefabricated wall sections is a common practice. The process of standing a stud wall begins with the construction of the stud wall on a horizontal surface such as a floor or a slab foundation. The stud wall includes top and bottom plates and a plurality of structural members, or studs, joining the top and bottom plates Such prefabricated wall sections, which may vary in length, generally are placed horizontally on the floor of the building structure. The edge that will ultimately become the lower edge of the horizontal wall section, is placed immediately adjacent the floor location on which it will rest in its vertical, upright position. The wall section is lifted and tilted into its desired vertical position, and the section is then secured to the sub-floor. Standing a stud wall typically requires a minimum of three workers to accomplish the task safely and easily. The stud wall is urged into a vertical position and held in place by two workers as a third worker secures the stud wall to other building structures.

The process works efficiently when the necessary manpower is present. However, with the trend toward do-it-yourself home building as well as the use of skeleton crews by commercial builders, the requisite minimum of three workers to stand a stud wall is not always available. When only two workers, such as a husband and wife building their own home, attempt to raise a stud wall the potential for serious injury is ever present.

Many devices such as mobile cranes, have been provided for use in lifting loads, including prefabricated walls. Mobile cranes are quite expensive and due to their weight and cumbersome nature, they are usually moved to a job site by the use of a trailer type vehicle. It has also been suggested to provide lifting devices, such as wall jacks, to raise the prefabricated wall sections from horizontal to final vertical position. Patents have issued disclosing a wall jack construction comprising a mechanical hoist having an elongated boom, the lower end of which is pivotally attached by a hinge to the floor of the building construction. Attached to a lower end portion of the boom is a winch with cable. The cable passes about a sheave on the upper end of the boom, and the outer end of the cable is suitable connected to the prefabricated wall adjacent its eventual upper end. The winch is manually operated to pivotally raise the wall section to a vertical position as the boom pivots from vertical to a generally 45 decree angular position during the lifting operation.

U.S. Pat. No. 5,322,404 provides a lifting device for raising prefabricated wall sections of a building from a horizontal to a vertical upright position during building construction.

U.S. Pat. No. 5,634,301 discloses a stud wall raising apparatus that permits a single user to raise a stud wall without assistance. The device has a T-shaped wall fixture, a fixed stud brace attached to the wall fixture by hinge means, a movable stud brace and a plurality of lock bars connecting the fixed and movable stud braces.

A need has been recognized in the art for a stud wall raising apparatus that allows a single individual to raise a stud wall so that the stud wall can be properly positioned and attached to other building structures. Such an apparatus must be simple to use, such that it can be operated by construction workers and lay persons alike. Furthermore, the device should be inexpensive to manufacture and durable when used in a commercial setting.

SUMMARY OF THE INVENTION

A lift to enable a wall, or other item, to be lifted to, or from, a vertical position is disclosed. The lift comprises a vertical body portion and horizontal lift arm and support legs. In one embodiment the freestanding unit is heavily supported through the use of braces and supports to allow the lifting unit to lift and support the wall without buckling or tipping. In other embodiments the unit is secured to a sub floor.

In its preferred embodiment, the wall lift device includes a footing member, an upright member, having a first end and a second end, a pulley, a flexible cable, the flexible cable having a first end and a second end, a cable guide member, a cable guide offset member, the cable guide offset member having a first end and a second end, and a wall engaging member.

The upright member first end is fixed to the footing member and extends in a substantially vertical direction from said footing member. The footing sits on a floor or other generally horizontal surface. The cable guide member is secured to the cable guide offset member first end, and the cable guide offset member second end is fixed to said upright member second end.

The flexible cable has its first end secured to the pulley, and its second end secured to the wall-engaging member, and is supported between its two ends by the cable guide member. The wall engaging member is preferably a "J" shaped hook.

The pulley and/or cable guide member can be designed to provide a mechanical advantage in lifting a wall. Such designs are well known in the art.

The relative dimensions of the upright member, the pulley offset member and the wall provide for a rotation of the wall through at least a 60 degree angle, and preferably through at least a 75 degree angle.

The upright member is at least about six feet long and can be eight feet long, for use with ten foot walls.

A reinforcing brace can be provided. The brace can have a first end fixed to the cable guide offset member, proximate the cable guide offset member first end, and a second end fixed to the upright member, at a position spaced from the upright member second end by a distance at least one third of the length of the upright member. Advantageously, it can be secured at a distance of least one half of the length of the upright member.

The method of raising a pre-constructed wall member, comprising the steps of:

a—constructing a wall member, having a first peripheral edge and a second peripheral edge in a position opposing the first edge. Most typically, the two opposing peripheral edges are parallel.

b—positioning the wall lift member on a base, as for example, a horizontal floor, c—attaching the wall engaging member to the first peripheral edge of the wall member, then d—pivoting the wall about the second peripheral edge of the wall member, and e—rotating the wall to the vertical position.

The pivoting of the wall about the second peripheral edge of the wall member is accomplished by winding the flexible cable about the pulley and raising the wall engaging member and the wall through an arc about the second peripheral edge of the wall.

BRIEF DESCRIPTION OF THE DRAWINGS

The advantages of the instant disclosure will become more apparent when read with the specification and the drawings, wherein.

DETAILED DESCRIPTION OF THE INVENTION

The disclosed wall lift provides an easy to move lift for conveniently lifting framed walls and the like into a vertical position. Although most commonly used for framed walls, the disclosed walled lift can be used to lift or lower any heavy item to or from a vertical position.

Figure 1:
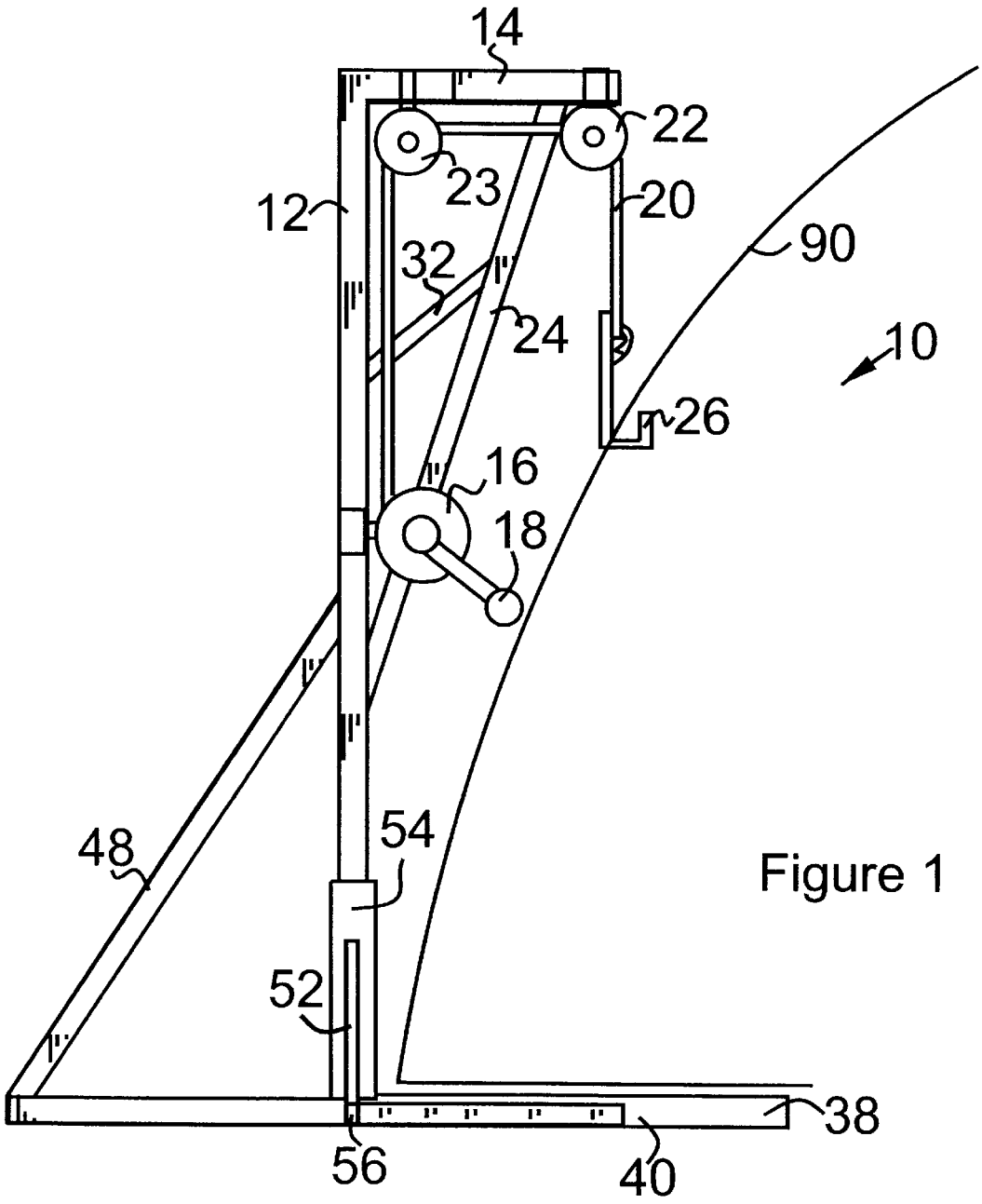
FIG. 1 is a side view of the free standing embodiment of the disclosed invention.
Figure 2:
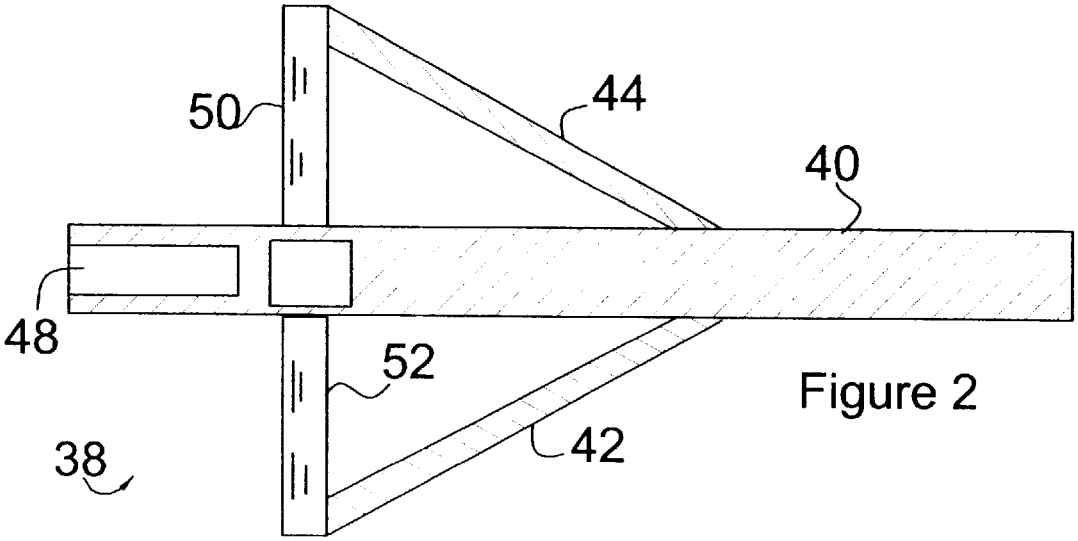
FIG. 2 is a top view of the embodiment of FIG. 1

The preferred embodiment of the wall lift 10 of FIG. 1 has a vertical body 12 which has a height generally determined by the weight and height of the wall and the maximum lift required. Thus, if 12 foot walls were being raised, the body 12 would require a greater height that if the walls were 8 foot. Approximately one third the way from the top of the body 12 a pulley 16 is securely attached. Although the pulley 16 illustrated is manually operated, a powered pulley can be used that is either attached to the body or separate unit. The term pulley, as employed herein, is used as generic term to mean any device which can either pull or wind a rope or flexible cable. The terms rope and cable are employed herein, essentially interchangeably to indicate any flexible device which can be drawn by a pulley, winch or similar device, and guided by a guide wheel, roller or similar device.

The pulley 16 has a handle 18 and standard locking means (not shown) to prevent the rope 20 from releasing and dropping the wall. A wall hook 26, designed to hook and maintain the grip on the wall during the lifting process, is affixed to the end of the rope 20. The means for locking, releasing and allowing the pulley to be turned in one direction is well known in the art. At the distal end of the body 12 a support arm 14 is secured to the body at right angles. The support arm 14 has a length approximately one third that of the length of the body 12 in order to provide the proper leverage and allow the wall to be moved along the arc 90. At the unattached end of the pulley arm 14 a pulley wheel 22 is affixed to receive and guide the rope 20. It is also preferable that a second wheel 23 be used proximate the connection of the support arm 14 and the body 12 to evenly guide the rope 20. A top angle brace 24 prevents the support arm 14 from flexing in response to the weight of the item being lifted. The top angle brace 24 is attached to the arm 14 proximate the distal end and to the body 12, at a point about two thirds the distance below the body 12/arm 14 connection, to form an acute triangle. A secondary brace 32 connects the brace 24 to the body 12, forming a second triangle, to further reinforce the top portion of the lift 10.

Figure 3:
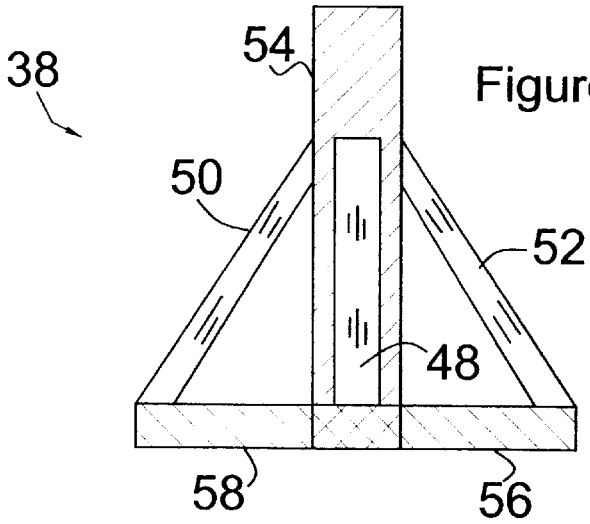
FIG. 3 is a rear view of the base of the embodiment of FIG. 1.

At the proximal end of the body 12 is the base unit, indicated generally as 38. The base of the lift 10, in the preferred free standing embodiment, comprises a support leg 40 which extends at right angles to the body 12. To add further strength, the connection between the support leg 40 and the body 12 is reinforced through use of connecting frame 54. Preferably the connecting frame 54 has an inner diameter slightly greater than that of the body 12 in order to receive the body 12. The connecting frame 54 and body 12 are positioned inward from the one end of the support leg 40 to allow for reinforcement of the connection between the connecting frame 54 and support leg 40 through use of a rear leg brace 48. A pair of side legs 56 and 58 extend at right angles to the support leg 40 and are connected at one end to the connecting frame 54 proximate the juncture between the connecting frame 54 and the support leg 40. The opposite ends of the side legs 56 and 58 are again connected to the connecting frame 54 through use of support angles 50 and 52. As can be seen from FIG. 3, the side legs, body and support angle form a right triangle. To provide further support to the structure, side supports 42 and 44 extend from the side legs 56 and 58, proximate the juncture between the side legs 56 and 58 and the support angles 50 and 52. The side supports 42 and 44 are affixed to the support leg 40, thereby forming a pair of right triangles. As can be seen in these figures, a number of angles are created through the supports and legs to provide stability and strength.

As the wall is lifted, pressure is applied to the pulley arm 14 at approximately the same angle as the top angle brace 24. It is thus preferred that the placement of the top angle brace 24 in respect to the support brace 28 be such that its position corresponds to the direction of force on the pulley arm 14. Thus, the force on the pulley arm is supported by the top angle brace 24 that extends between the pulley arm 14 and the body 12. The support brace 32 is preferably secured to the body 12 at a point higher than the top angle brace 24 to further prevent the body 12 from bending at a point just below the connection between the top angle brace 24 and the body 12. The braces can be connected to the body at other locations, however, the stability of the lift must be maintained. Any position, as would be evident to those versed in the art in view of this disclosure, which maintains the integrity of the lift can be used.

In the preferred embodiment the material used is aluminum tubing having cross sectional peripheries ranged from 1×1 to 2×2. The specifications set forth in Table I are provided for example only and are not intended to limit the scope of the invention.

TABLE I

| | periphery | length |
|---|---|---|
| vertical body 12 | 1.5 × 1.5 × ⅛ | 78.0 |
| support arm 14 | 1.5 × 1.5 × ⅛ | 35.0 |
| top angle brace 24 | 1 × 1 × ⅛ | 59.69 |
| secondary brace 32 | 1 × 1 × ⅛ | 24.44 |
| support leg 40 | 2 × 1 × ⅛ | 45.0 |
| rear leg brace 48 | 1 × 1 × ⅛ | 15.0 |
| side legs 56 and 58 | 1 × 1 × ⅛ | 9.0 |
| support angles 50 and 52 | 1 × 1 × ⅛ | 15.0 |
| side supports 42 and 44 | 1 × 1 × ⅛ | 26.81 |
| connecting frame 54 | 2 × 2 × ⅛ | 18.00 |

Figure 4:
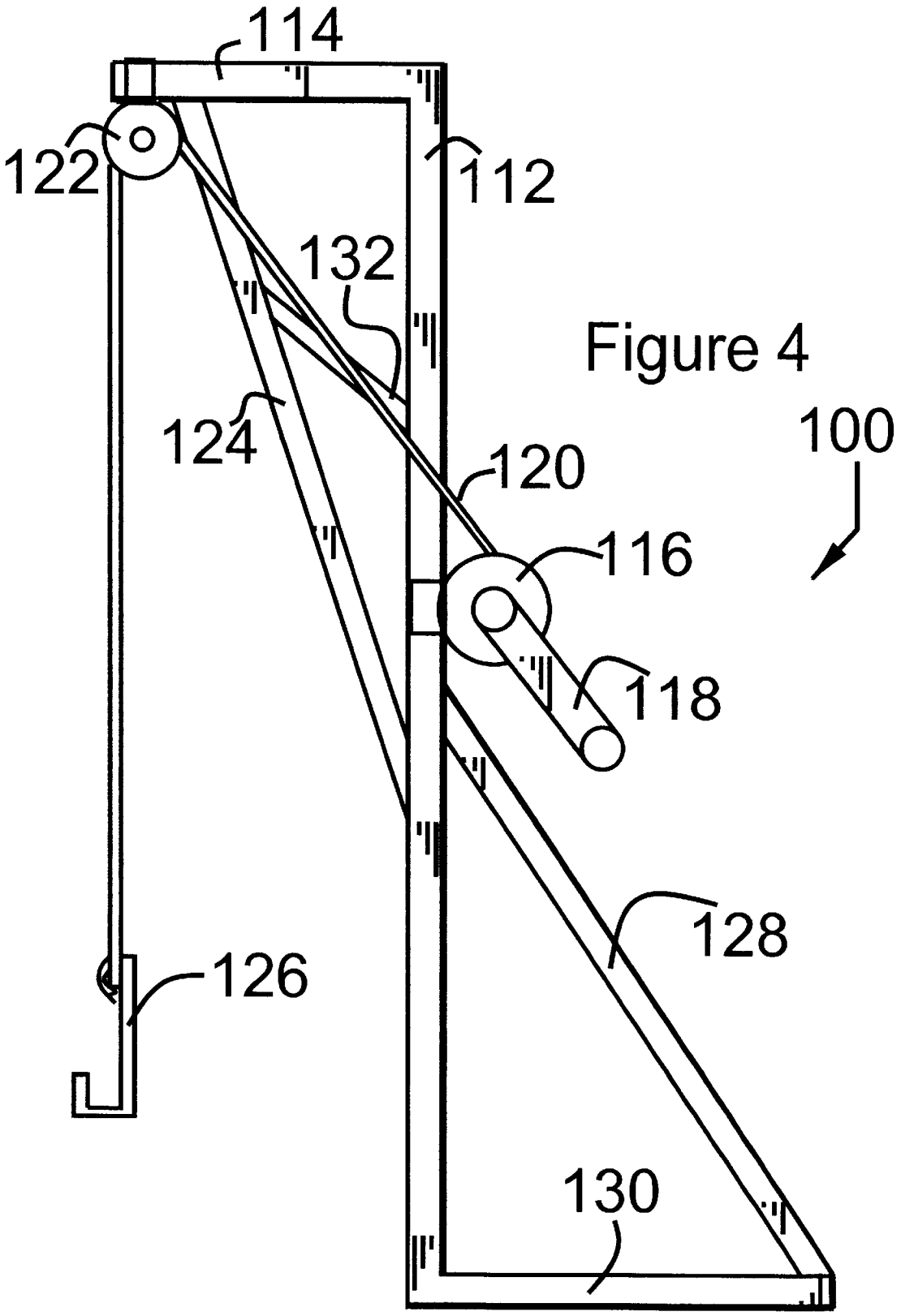
FIG. 4 is a side view of an alternate embodiment of an assembled wall lift having an opposing support leg.
Figure 5:
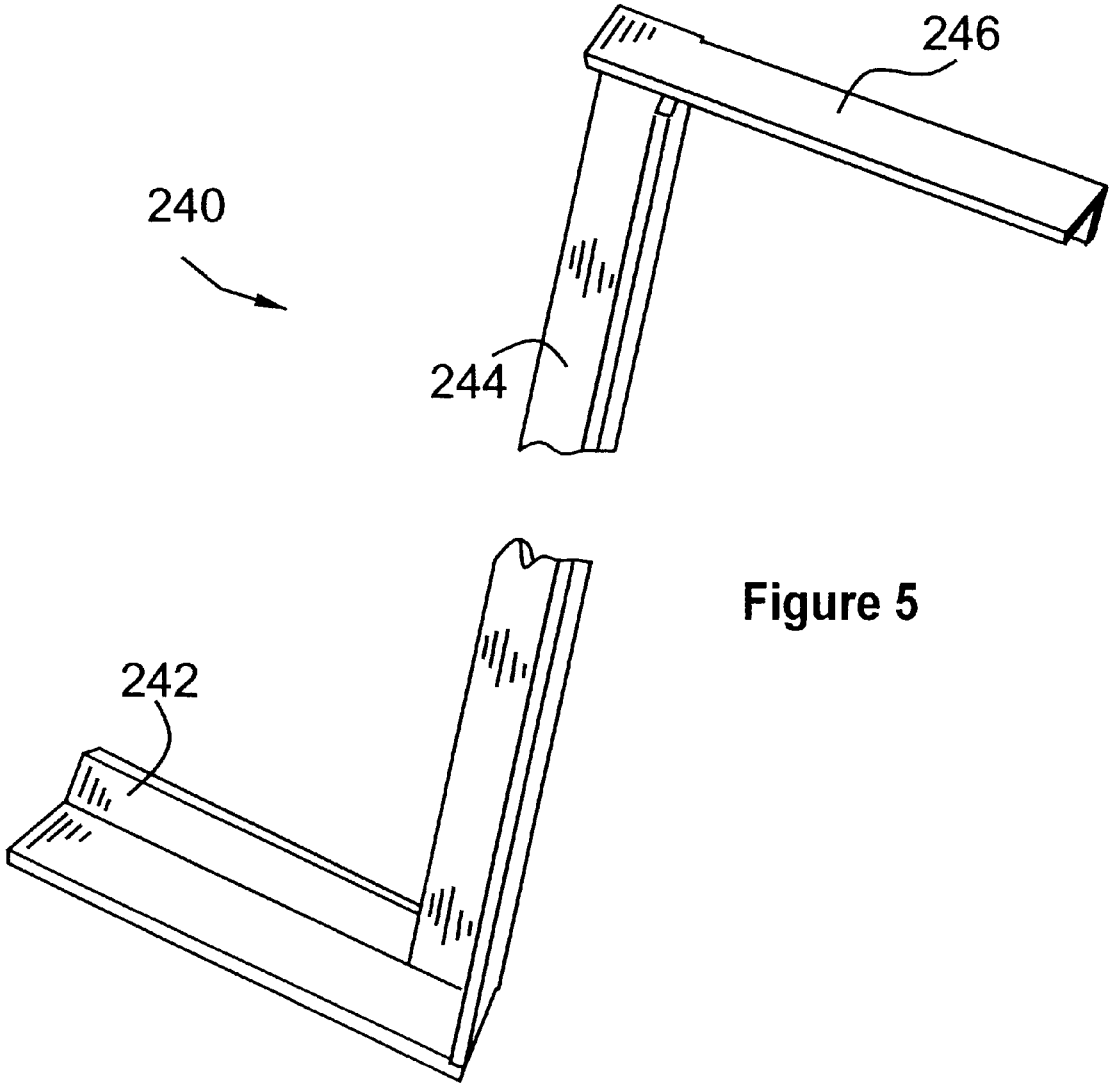
FIG. 5 is an exploded view of the L-shaped material used to construct the lift.

An alternate embodiment is illustrated in FIG. 4 wherein in lift 100 the leg brace 130 and body 112 are manufactured from L-shaped steel with holes along the length. As the lift 100 is free standing, the holes allow the leg brace 130 to be secured the lift 100 to the sub-floor through use of screws or bolts. The support brace 128 serves to reinforce the leg brace 130 to the body 112 to prevent buckling. The top angle brace 124 and secondary brace 132 provide additional support and structural strength. The arm 114, support brace 128, top angle brace 124, and secondary brace 132 are manufactured from piping having a diameter and thickness sufficient to provide the necessary strength and support. The piping is welded to the L-shaped steel to maintain maximum stability. Alternatively, the entire lift 240 can be manufactured from the L-shaped steel as illustrated in part in FIG. 5, illustrating leg brace 242, body 244 and arm 246. Other materials that provide for the same rigidity and stability as those disclosed herein can be substituted and will be obvious to those skilled in the art.

Figure 6:
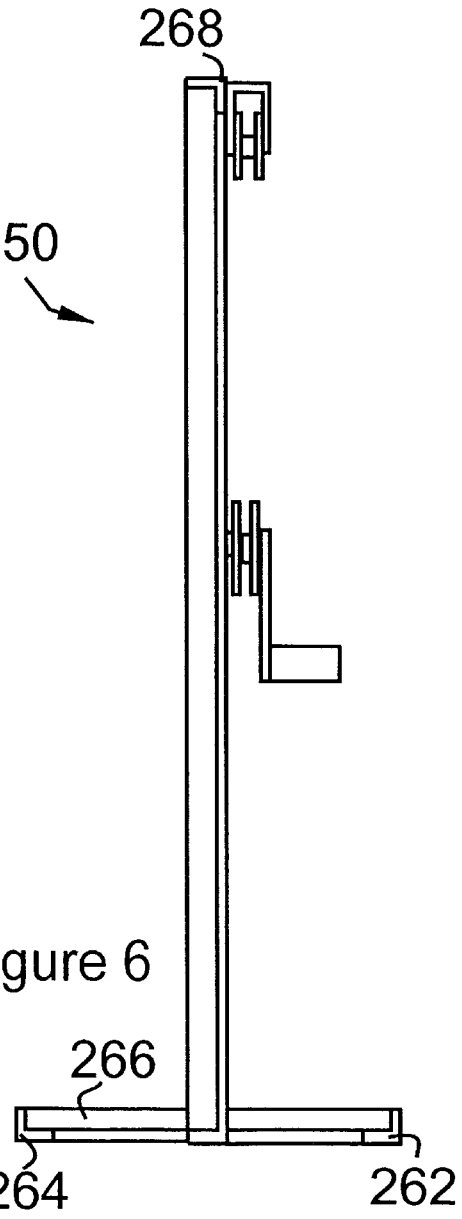
FIG. 6 is a front view of an alternate wall lift.

FIG. 6 illustrates a front view of an alternate wall lift 250 wherein a pair of legs 262 and 264, separated by support 266, extend parallel to, and on the same plane, as the overhead arm 268. The use of the pair of legs 262 and 264 provides the advantage that the lift 250 would be self supporting and, if the lifted load is sufficiently light, would not require securing to the sub-floor.

Figure 7:
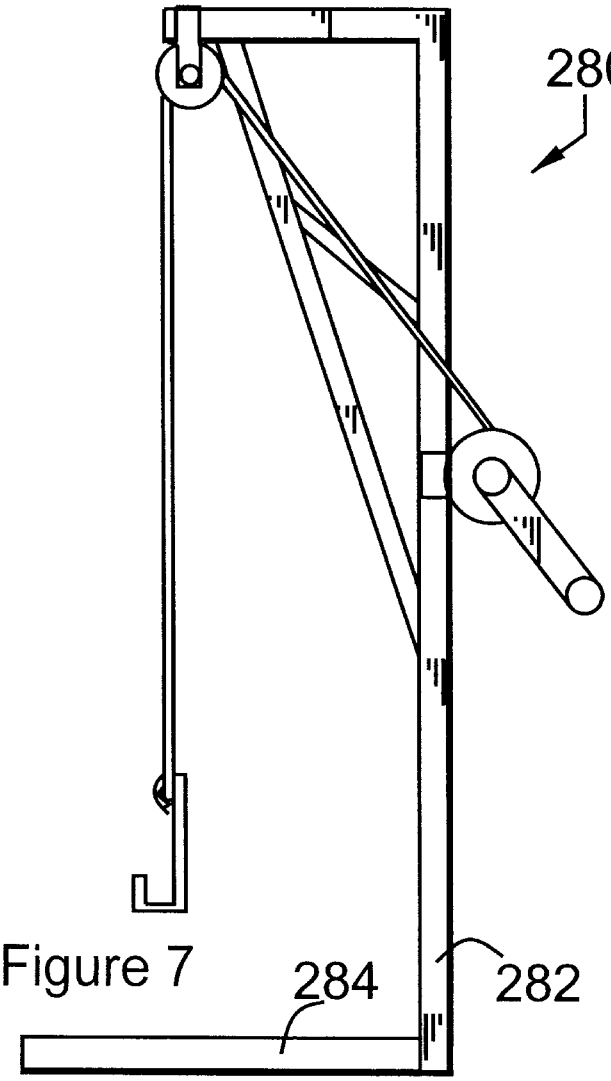
FIG. 7 is a side view of an alternate embodiment of the wall lift having a parallel support leg.

FIG. 7 illustrates an additional embodiment of the invention wherein lift 280 has a single leg 284 at right angles to the body 282. The use of a single leg 284 would require the lift 280 to be secured, as stated heretofore, to the sub-floor of the structure.

Figure 8:
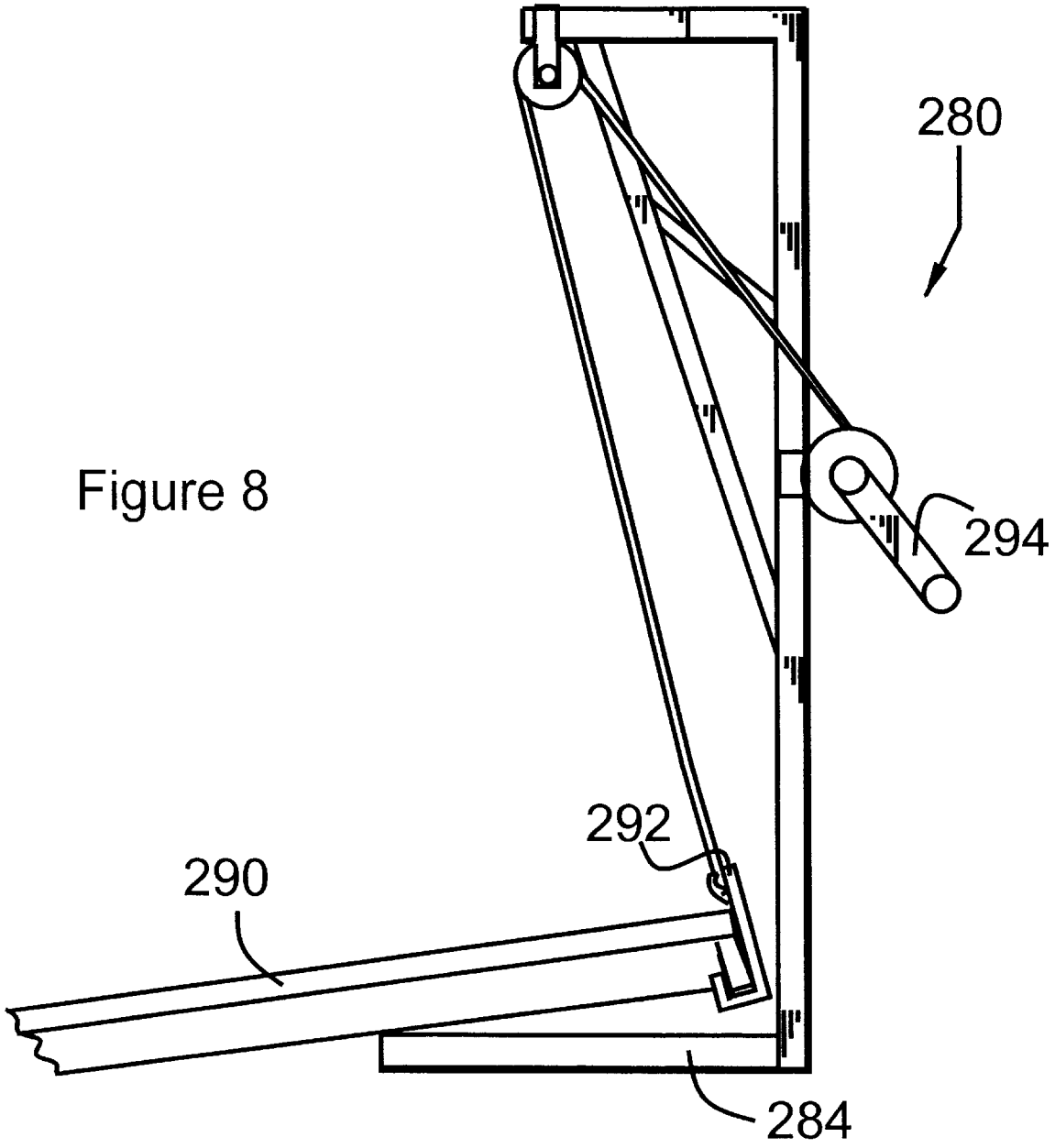
FIG. 8 is a side view of the wall lift hooked onto a wall panel.
Figure 9:
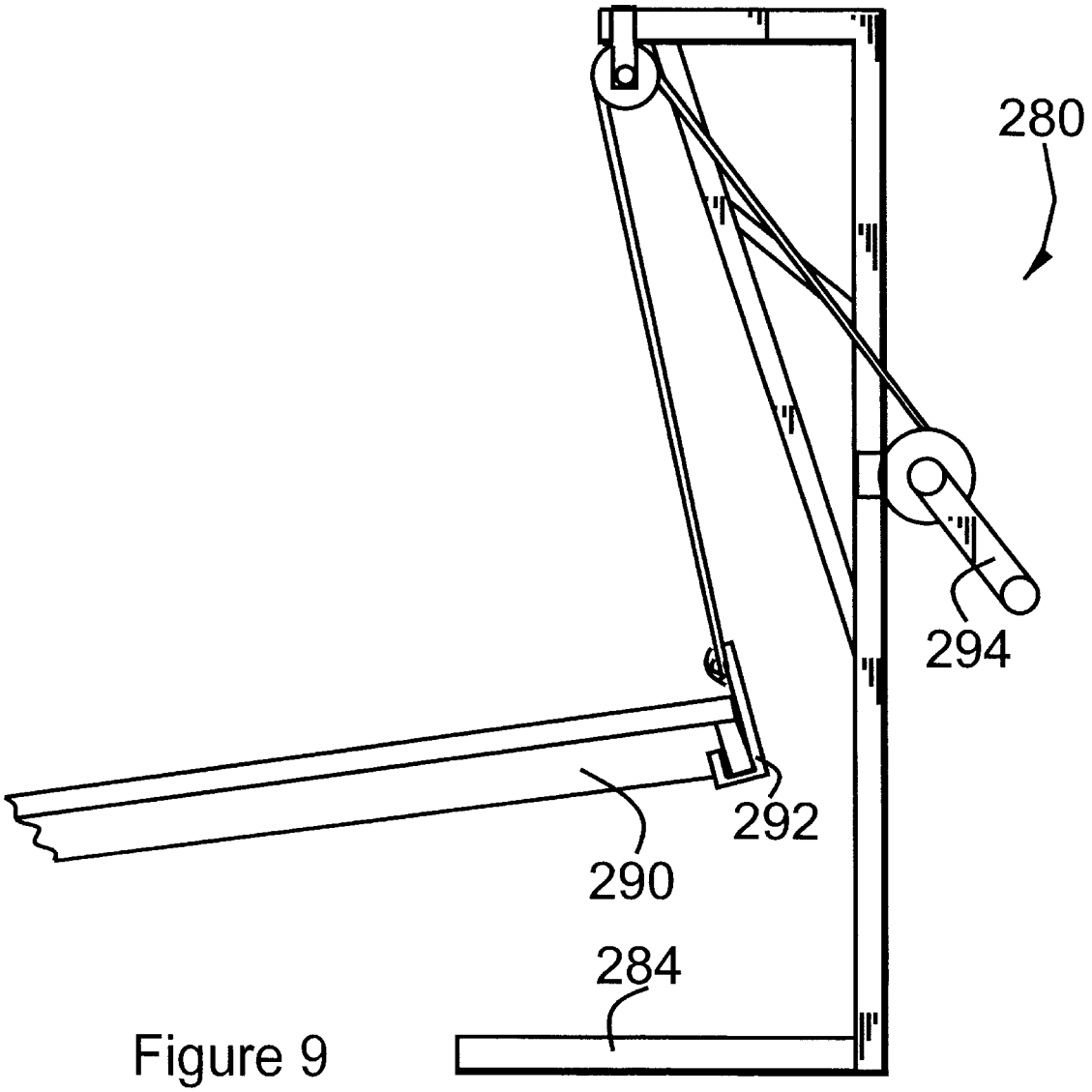
FIG. 9 is a side view of the wall lift in the initial stages of lifting a wall panel.
Figure 10:
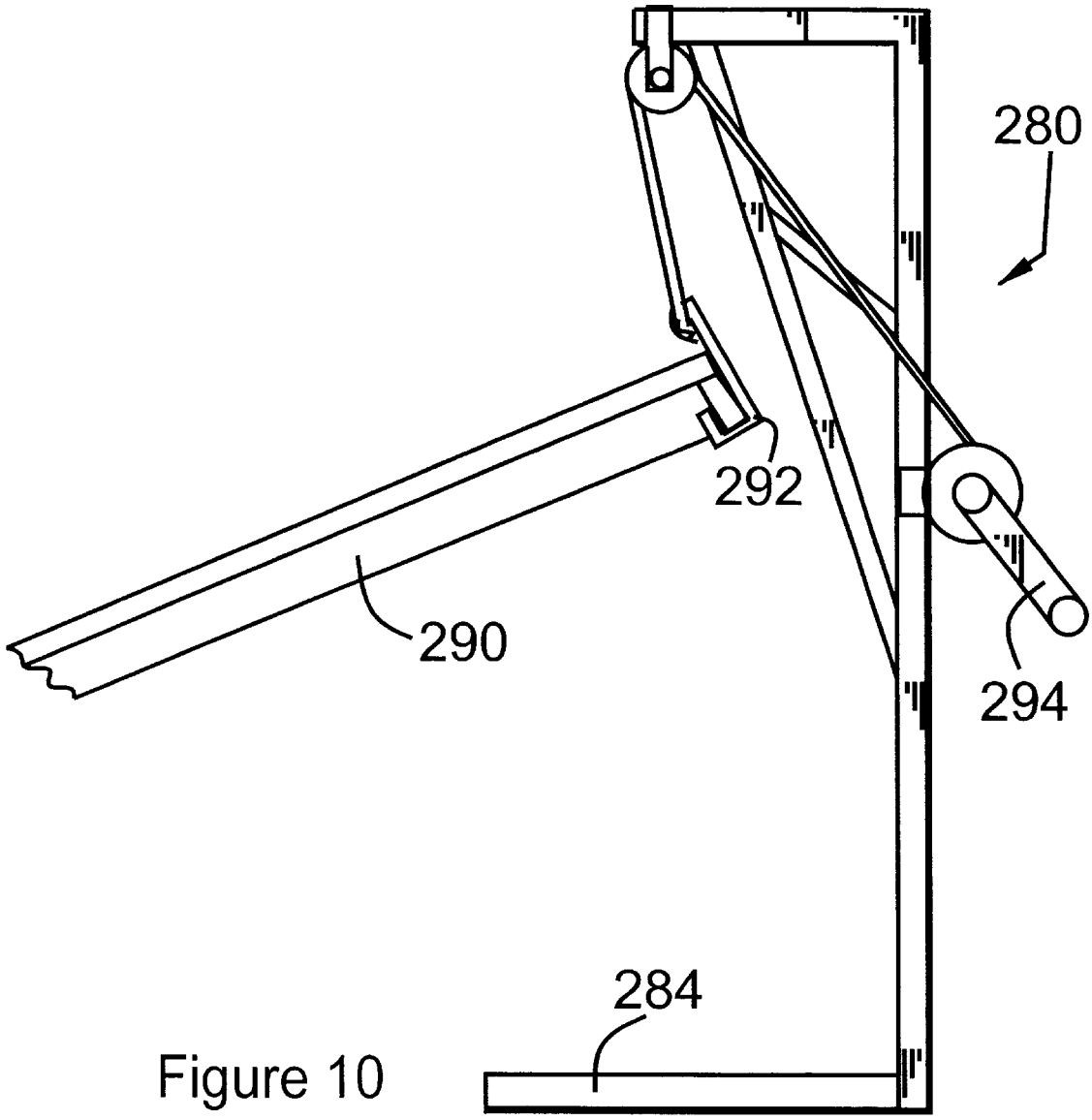
FIG. 10 is a side view of the wall lift in the final stages of lifting a wall panel.
Figure 11:
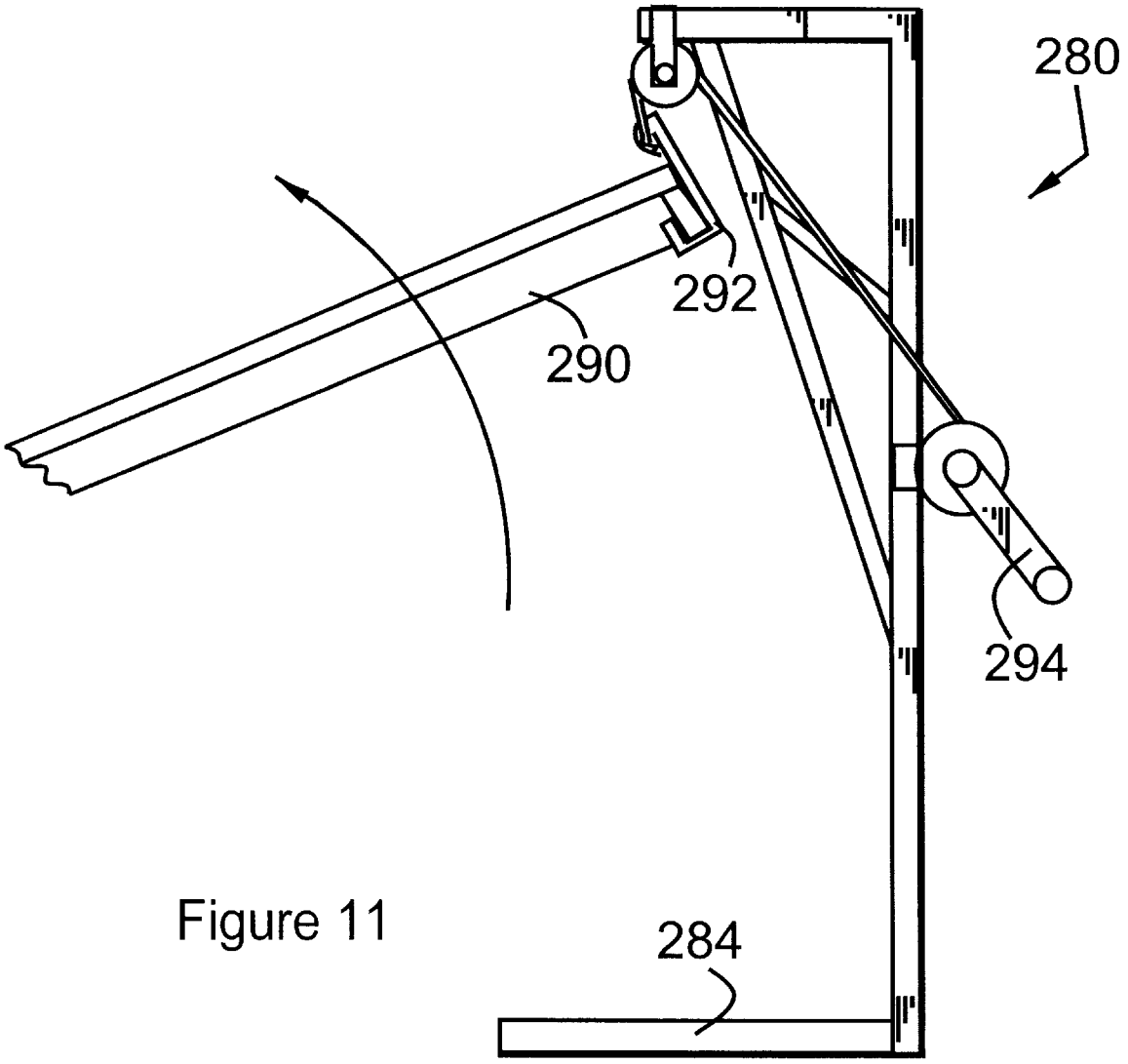
FIG. 11 is a side view of the wall lift as it reaches the furthest point of lift.
Figure 12:
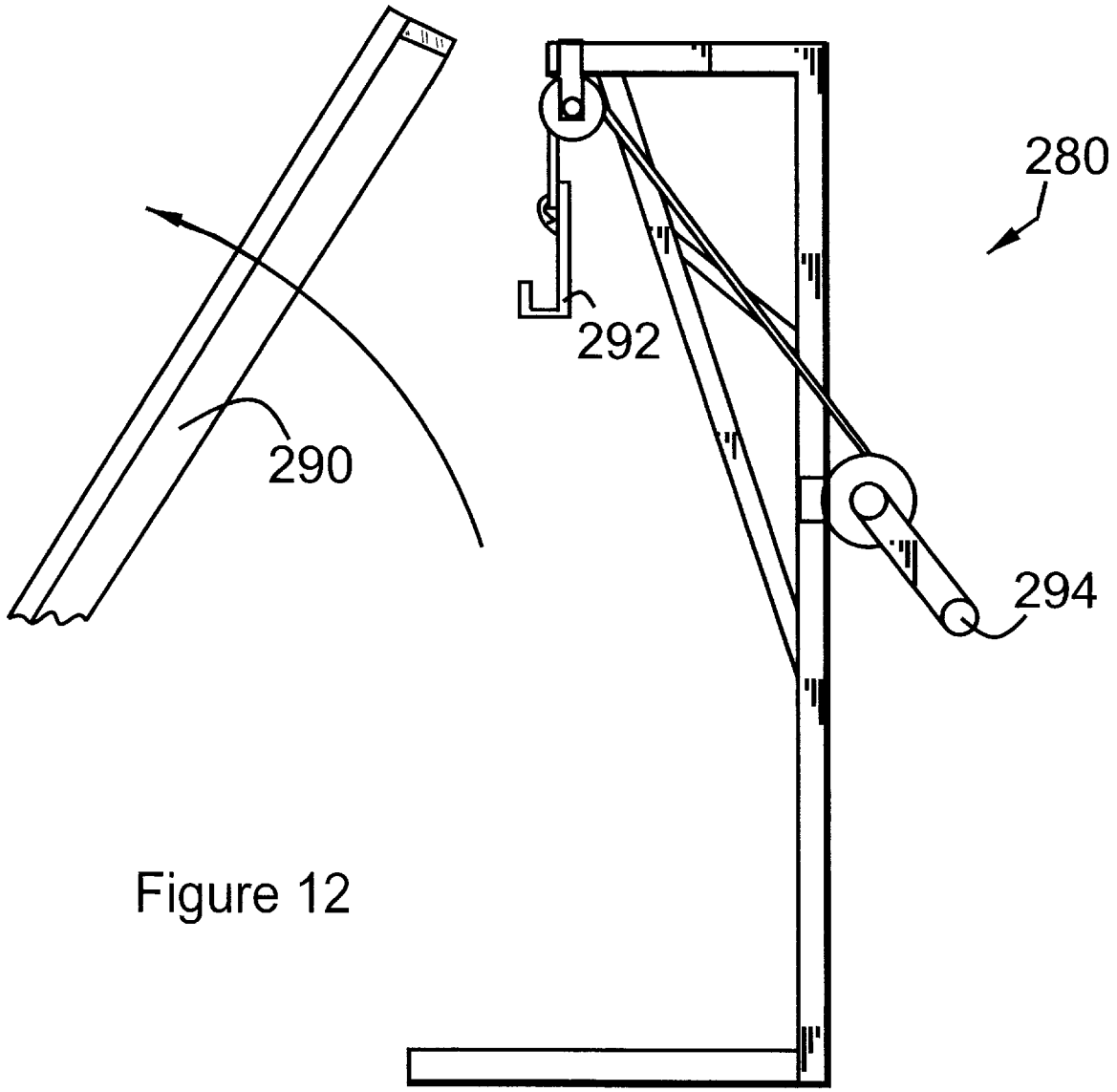
FIG. 12 is a side view of the arc taken by the wall towards the vertical.

FIGS. 8 through 12 illustrate the lifting process of the wall 290 using lift 280. As can be seen in FIG. 8, in the initial position, the wall 290 is placed on the base 284 and the hook 292 placed over the top of the wall 290. The pulley handle 294 is turned to raise the wall 290 to the maximum height achievable by the lift 280, as illustrated in FIG. 11. Once the pulley handle 294 is locked in position, the user can simply raise the wall into position. At this height level a relatively light weight wall can easily be lifted by a single person to a vertical position along the arc path illustrated in FIG. 12.

Figure 13:
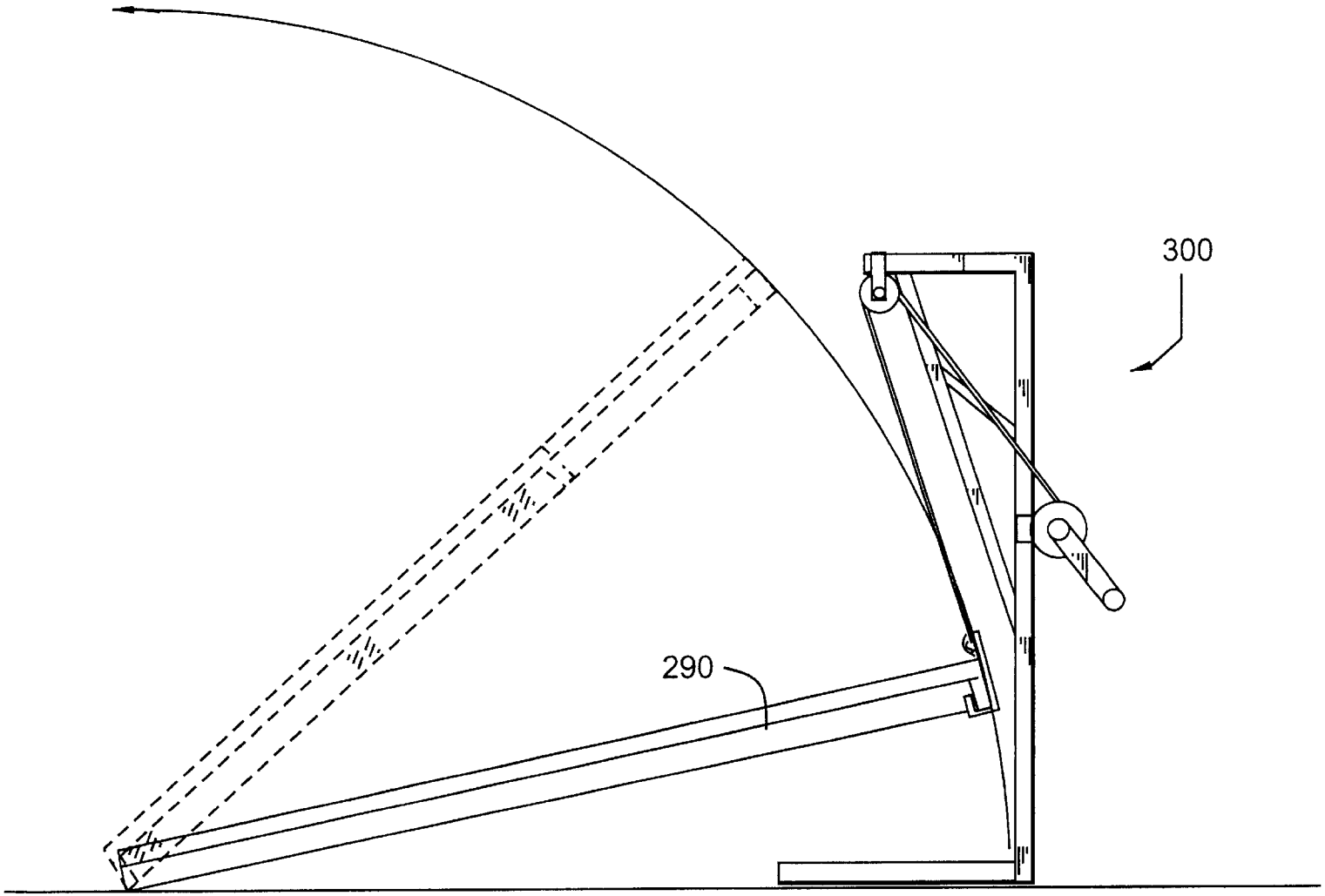
FIG. 13 is a side view of the arc created using a five foot lift.
Figure 14:
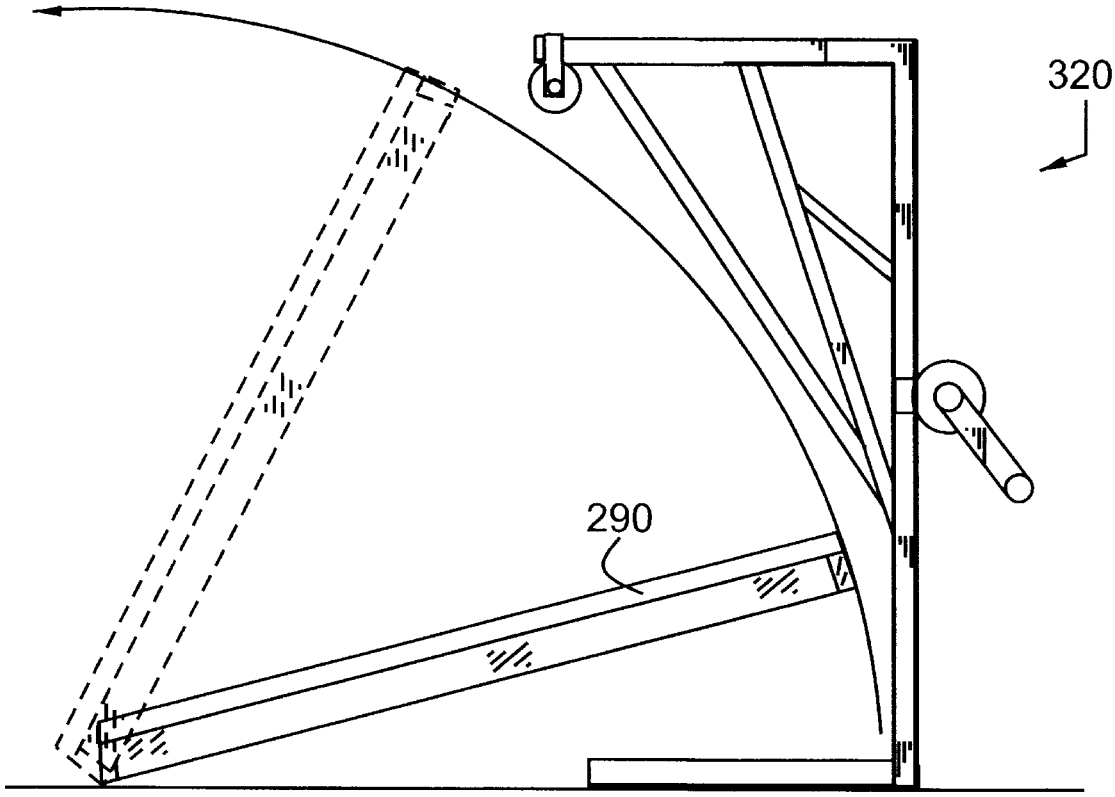
FIG. 14 is a side view of the arc created using an eight foot lift.

FIGS. 13 and 14 illustrate the arc of an eight foot wall 290 in relation to a five (5) foot lift 300 versus an eight (8) foot lift 320. As can be seen in these figure, the point along the arc to which the lift 300 can take the wall 290 is further from vertical than the point obtained with lift 320. The determination of the lift height required is based on weight of the wall and number of people available to lift the wall to the vertical position. Therefore a large 400 pound wall would required either a larger number of people or a taller lift than a 200 pound wall.

The critical dimensions of the disclosed invention lie with the height of the wall, height of the body and length of the arm. The length of the arm must be sufficient to swing the wall out as close to vertical as possible. It should be noted that as the wall approaches the vertical, the force necessary to rotate the wall fully to the vertical decreases. The force necessary to raise the wall decreases directly with the decreasing of the horizontal distance between a vertical line through the center of gravity of the wall and the pivot point. That is, the lifting force required to pivot the wall through the first ten degrees of rotation is dramatically greater than the force required to pivot the wall through the last ten degrees of rotation. Accordingly, it is not critical that the device be sufficiently tall to raise the wall to the full vertical position. Depending upon the weight and height of the wall, a point is reached at which the remaining moving can easily be accomplish by one person. Preferably, the proportions of the device relative to the wall should provide for at least a 45 degree rotation, and preferably, at least a 60 degree rotation of the wall. Relative proportions which provide for a rotation of the wall to at least a 75 degree angle is most preferred. At the 75 degree angle, one person can readily rotate a large wall to the full vertical position.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A device for use in raising a wall, comprising:

a footing member, an upright member, said upright member having a first end and a second end, said upright member first end being fixed to said footing member and extending in a substantially vertical direction from said footing member, a support arm, said support arm having a first end and a second end, said first end being affixed to said upright member second end such that said support arm is at a right angle to said upright member, a brace member, said brace member having a first end and a second end, said first end being fixed to said support arm, proximate said support arm first end, and said brace member second end being fixed to said upright member, a pulley, said pulley being affixed to said upright member, a cable guide member, said cable guide member being fixed adjacent to said support arm second end, a flexible cable, said flexible cable having a first end and a second end, said cable first end being secured to said pulley, and being supported between said first end and said second end by said cable guide member, a wall engaging member, said wall engaging member being connected to said flexible cable second end, wherein rotation of said pulley causes said wall engaging member to change positions on a vertical plane in relation to said footing member, said support arm length in ratio to said upright support length enabling an edge of a wall to be lifted in a 90 degree arc during said change of positions of said wall engaging member.

2. The device of claim 1 further comprising a sub-brace, a first end of said sub-brace being affixed to said upright member and a second end of said sub-brace being affixed to said brace member.

3. The device of claim 1, wherein said brace member second end is fixed to said upright member at a position spaced from said upright member second end equal to a distance at least about one third of the length of said upright member, at least one of said pulley and said cable guide member provides a mechanical advantage in lifting a wall.

4. The device of claim 1, wherein said brace member second end is fixed to said upright member, at a position spaced from said upright member second end by a distance equal to at least about one half of the length of said upright member.

5. The device of claim 1, wherein the relative dimensions of said upright member, said support arm and a wall provide for a rotation of the wall through at least a 60 degree angle.

6. The device of claim 1, wherein the relative dimensions of said upright member, said support arm and a wall provide for a rotation of the wall through at least a 75 degree angle.

7. The device of claim 3, wherein said upright member is at least about six feet long.

8. The device of claim 1, wherein said wall engaging member is a "J" shaped hook.

9. The device of claim 1, wherein said upright member is between six and eight feet long.

10. The device of claim 1, further comprising a second cable guide member, said second cable guide member being mounted to said upright member second end a distance from said footing member of at least about six feet.

11. The device of claim 1 wherein said footing member is at right angles to said upright member and parallel to said support arm, said footing member having a first end and a second end, said footing member first end being affixed to said upright member and a distance between said footing member first end and said footing member second end being greater than a distance between said support arm first end and said support arm second end.

12. The device of claim 11 wherein said footing member is T-shaped, said T-shape having a body member, a leg member and an intersection, said footing member first end being at said intersection.

13. The device of claim 12 further comprising a pair of lower brace members, a first end of each of said lower braces being affixed to each end of said leg member and a second end of said lower braces being affixed to said upright member, wherein each of said pair of lower braces, said leg member and said upright support form a pair triangular supports along the same plane.

14. The device of claim 13 further comprising a rear support, said rear support having a first end affixed at right angles to said upright member and in line with said body member.

15. The device of claim 14 further comprising a rear brace, said rear brace having a first end affixed to a second end of said rear support and a second end affixed to said upright member, thereby forming a triangular support consisting of said upright member, said rear support and said rear brace.

16. The device of claim 1 wherein said footing member is off set, at a right angle, from said upright member and in a parallel plane to said support arm, said footing member further comprising securing means, said securing means enabling said footing member to be secured to a support structure.

17. The device of claim 16 further comprising a rear brace, said rear brace having a first end affixed to a second end of said rear support and a second end affixed to said upright member, thereby forming a triangular support consisting of said upright member, said rear support and said rear brace.

18. A wall lifting device for raising a wall to about a vertical position, comprising:

a footing member, an upright member, said upright member having a first end and a second end, said upright member first end being fixed to said footing member and extending in a substantially direction from said footing member, an support arm, said support arm having a first end and a second end, said first end being affixed, at right angles, to said upright member second end, a brace member, said brace member having a first end and a second end, said first end being fixed to said support arm, proximate said support arm first end, and said brace member second end being fixed to said upright member at a position spaced from said upright member second end equal to a distance at least about one third of the length of said upright member, a sub-brace, a first end of said sub-brace being affixed to said upright member and a second end of said sub-brace being affixed to said brace member, a pulley, said pulley being affixed to said upright member, a cable guide member, said cable guide member being fixed adjacent to said support arm second end, a flexible cable, said flexible cable having a first end and a second end, said cable first end being secured to said pulley, and being supported between said first end and said second end by said cable guide member, a wall engaging member, said wall engaging member being connected to said flexible cable second end, said footing member being a T-shaped member, said T-shape having a body member, a leg member and an intersection, said leg member first end being at said intersection and at right angles to said upright member and parallel to said support arm; a pair of lower brace members, a first end of each of said lower braces being affixed to each end of said leg member and a second end of said lower braces being affixed to said upright member, each of said pair of lower braces, said leg member and said upright support form a pair triangular supports along the same plane; a rear support, said rear support having a first end affixed at right angles to said upright member and in line with said body member; and a rear brace, said rear brace having a first end affixed to a second end of said rear support and a second end affixed to said upright member, thereby forming a triangular support consisting of said upright member, said rear support and said rear brace, wherein said footing member enables wall lifting device to be free standing while rotation of said pulley causes said wall engaging member to change positions on a vertical plane in relation to said footing member, the relative dimensions of said upright member, said support arm and a wall providing for a rotation of the wall through at least a 75 degree angle.

19. A method of raising a pre-constructed wall member, comprising the steps of:

a—constructing a wall member, said wall member having a first peripheral edge and a second peripheral edge, said first peripheral edge being opposite said second peripheral edge, b—positioning said wall member horizontally in a position to enable said second peripheral edge to be positioned for securing said wall member in a vertical position, c—positioning a wall lift member on a base, adjacent to said horizontal wall member, said wall lift member comprising, a footing member, an upright member, said upright member having a first end and a second end, said upright member first end being fixed to said footing member and extending in a substantially vertical direction from said footing member, an support arm, said support arm having a first end and a second end, said first end being affixed to said upright member second end such that said support arm is at a right angle to said upright member, a brace member, said brace member having a first end and a second end, said first end being fixed to said support arm, proximate said support arm first end, and said brace member second end being fixed to said upright member, a pulley, said pulley being affixed to said upright member, a cable guide member, said cable guide member being fixed adjacent to said support arm second end, a flexible cable, said flexible cable having a first end and a second end, said cable first end being secured to said pulley, and being supported between said first end and said second end by said cable guide member, a wall engaging member, said wall engaging member being connected to said flexible cable second end, c—attaching said wall engaging member to said first peripheral edge of said wall member, d—rotating said pulley to cause said wall engaging member to change positions on a vertical plane, e—pivoting said wall member about said second peripheral edge of said wall member, f—rotating said wall member to about a vertical position, g—securing said wall member in said vertical position, h—rotating said pulley to release said wall engaging member, i—removing said wall engaging member from said firs peripheral edge of said wall member, j—repeating steps a— through i— until all wall members are secured in a vertical position.

20. The method of claim 19, wherein said pivoting of said wall about said second peripheral edge of said wall member comprises the step of winding said flexible cable about said pulley and raising said wall engaging member and said wall through an arc about said second peripheral edge of said wall.

* * * * *